US005447392A

United States Patent [19]

Marshall

[11] Patent Number: 5,447,392

[45] Date of Patent: Sep. 5, 1995

[54] BACKSPAN STRESS JOINT

[75] Inventor: Peter W. Marshall, Houston, Tex.

[73] Assignee: Shell Oil Company, Houston, Tex.

[21] Appl. No.: 57,076

[22] Filed: May 3, 1993

[51] Int. Cl.[6] ..... E02B 17/00

[52] U.S. Cl. ..... 405/224.4; 405/202; 405/223.1; 405/224.2

[58] Field of Search ..... 405/195.1, 202, 223.1, 405/224, 224.2, 224.3, 224.4; 114/264, 265; 166/350, 359, 367

[56] References Cited

U.S. PATENT DOCUMENTS

| | | | |
|---|---|---|---|
| 3,605,668 | 9/1971 | Morgan | 405/224.2 X |
| 4,576,516 | 3/1986 | Denison | 405/224.4 |
| 4,633,801 | 1/1987 | Marshall . | |
| 4,657,439 | 4/1987 | Petersen . | |
| 4,702,321 | 10/1987 | Horton . | |
| 4,708,525 | 11/1987 | Beynet et al. | 405/224.2 |
| 4,911,483 | 3/1990 | Delamare | 405/202 X |
| 5,020,942 | 6/1991 | Pallini | 405/223.1 X |
| 5,046,896 | 9/1991 | Cole | 405/224.2 X |
| 5,269,629 | 12/1993 | Langner | 405/195.1 |

OTHER PUBLICATIONS

Kerckhoff et al., "Minifloater: A Deepwater Production Alternative," *Ocean Industry,* vol. 25, No. 7, Sep. 1990.

Anon., "Eureka!", *Offshore Engineer,* Dec. 1990.

R. S. Glanville et al., "Analysis of Spar Floating Drilling and Storage Structure," *OTC 6701,* May 1991.

J. E. Halkyard, "Analysis of Vortex-Induced Motions and Drag for Moored Bluff Bodies," *OTC 6609,* May 1991.

M. F. Allison, "The Value of Reservoir Test Systems (Exploratory Phase) in High-Cost Offshore Areas", *SPE 22773,* Oct. 1991.

Goldsmith et al., "New Well System for Deepwater TLP Eases Production Operations," *SPE 22769,* Oct. 1991.

S. B. Hodges et al., "A Comparison of Methods for Predicting Extreme TLP Tendon Tensions," *OTC 6887,* May 1992.

P. W. Marshall, "Backspan Stress Joint," *OTC 7528,* May 3, 1993.

*Primary Examiner*—David. H. Corbin

*Attorney, Agent, or Firm*—Mark A. Smith

[57] ABSTRACT

An improved support system is disclosed for providing flexibility to a restrained termination of a highly pressurized, highly tensioned tubular element which extends from a subsea facility to a compliant structure. The tubular element is provided with an intermediate tension relief connection which separates a running span from a backspan and operably connects the tubular element to a support structure, transfering thereto a significant portion of the tension carried by the tubular element. This connection passes angular rotation of the tubular element but resists lateral motion, in effect forming a node in the deflection of the tubular element. A backspan is thus created in the tubular element having a tension load which is reduced from that in the running span, thereby increasing the flexibility apparent at the end of the running span, while maintaining a relatively restrained termination of the tubular element at the distal end of the backspan. Another aspect of the present invention is a method for increasing the flexibility at a termination of a highly tensioned, pressurized tubular element connecting a subsea facility to a compliant structure.

31 Claims, 8 Drawing Sheets

FIG. 5
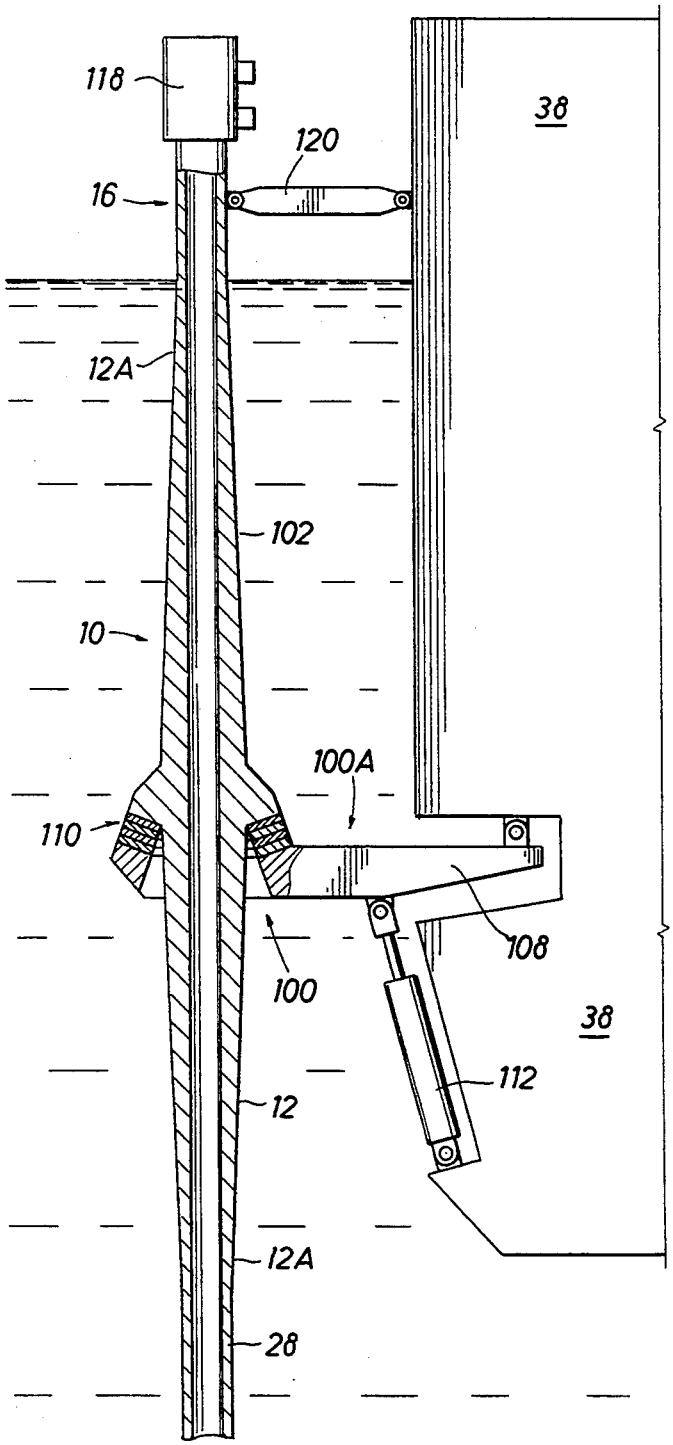
FIG. 7B
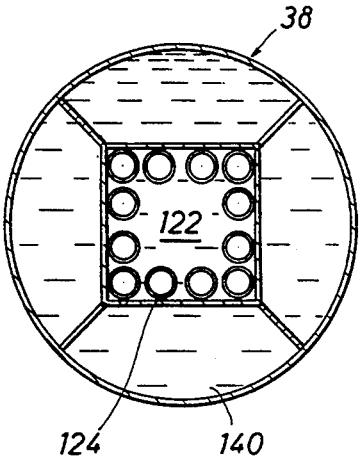
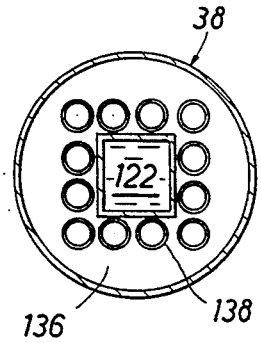
FIG. 7C

BACKSPAN STRESS JOINT

BACKGROUND OF THE INVENTION

The present invention relates to a method and apparatus for terminal connections for highly tensioned tubular elements in offshore applications. More particularly, the present invention relates to a method and system for flexibly connecting in a restrained termination pressurized, highly tensioned tubular elements extending from subsea facilities to compliant structures.

Traditional bottom-founded platforms having fixed or rigid tower structures have been taken to their logical depth limits in the development of offshore oil and gas reserves. Economic considerations suggest that alternatives to this traditional technology be used in the development of deepwater prospects.

Alternative designs have been developed for various configurations of "compliant structures", e.g. tension leg platforms, compliant towers, articulated towers and floating production facilities, which can support offshore developments in very deep water more economically than traditional fixed platforms. Further, a promising area being investigated among compliant structures is the use of minimal structures. Examples include tension leg well jackets and spar structures ranging form those providing completion and workover facilities through mini-spars and to riser buoys. All of these compliant structures are designed to "give" in a controlled manner in response to dynamic environmental loads rather than rigidly resist those forces. This results in relative motion between a foundation, template or other subsea facility and the topside facilities of the compliant structure.

Various components connect the subsea and topside facilities, including tubular elements such as production risers, export risers and tendons. These connections require a high degree of angular flexibility. However, accommodating this angular freedom with tubular goods in applications which must maintain continuous, hard-piped bores is a difficult challenge for traditional materials capable of meeting the rigorous pressure and tension requirements.

Various stress joint arrangements have been devised to help meet this challenge. Nevertheless, this remains a limiting factor in the design of compliant structures and offshore facilities. Thus there is a need for an improved system and method for providing flexibility to a restrained termination of highly pressurized, highly tensioned tubular elements in such offshore applications.

SUMMARY OF THE INVENTION

Toward the fulfillment of this need, the present invention is an improved support system for providing flexibility to a restrained termination of a highly pressurized, highly tensioned tubular element which extends from a subsea facility to a compliant structure. The tubular element has an elongated running span and is provided with an intermediate tension relief connection. This connection operably connects the tubular element to a support structure and transfers thereto a significant portion of the tension carried by the tubular element. Further, this connection passes angular rotation of the tubular element but resists lateral motion, in effect forming a node in the deflection of the tubular element. A backspan is thus created in the tubular element having a tension load which is reduced from that in the running span from which it is separated by the intermediate tension relief connection. This arrangement increases the flexibility apparent at the end of the running span, while maintaining a restrained termination of the tubular element at the distal end of the backspan.

Another aspect of the present invention is a method for increasing the flexibility at a termination of a highly tensioned, pressurized tubular element connecting a subsea facility to a compliant structure. In this method the axial load in the tubular element is relieved at an intermediate support which resists lateral displacement, but passes angular rotation to a backspan of the tubular element carrying a reduced axial load. The tubular element terminates in a restraining fixture at the distal end of the backspan, spaced apart from the intermediate support.

BRIEF DESCRIPTION OF THE DRAWINGS

The brief description above, as well as further objects, features and advantages of the present invention will be more fully appreciated by reference to the following detailed description of the preferred embodiments which should be read in conjunction with the accompanying drawings in which:

FIG. 5 is a side elevation view of one embodiment of a backspan stress joint constructed in accordance with the present invention.

FIGS. 7A–7D illustrate a spar type compliant structure provided with a backspan stress joint in accordance with the present invention.

DETAILED DESCRIPTION OF THE PREFERRED EMBODIMENT

Figure 1A:
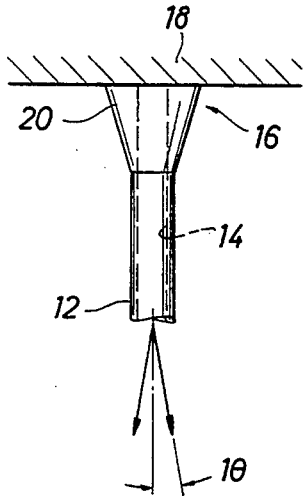
FIG.1A (PRIOR ART)
FIG. 1A is a schematic representation of a stress joint without the improvement of the present invention.

FIG. 1A schematically illustrates a stress joint arrangement 11 not provided with the benefits of the present invention. Here, a tubular element 12 having a continuous, hard piped bore 14 has a restrained termination 16. Tubular element 12 might find application in high pressure, high tension offshore applications such as for a riser, a tether or tendon member, or a combined riser-tether member for a deepwater compliant structure. In this example, the termination is rigidly secured to restraining fixture 18 through terminal stress joint 20. This tapered stress joint will permit a maximum angle Θ under load.

Figure 1B:
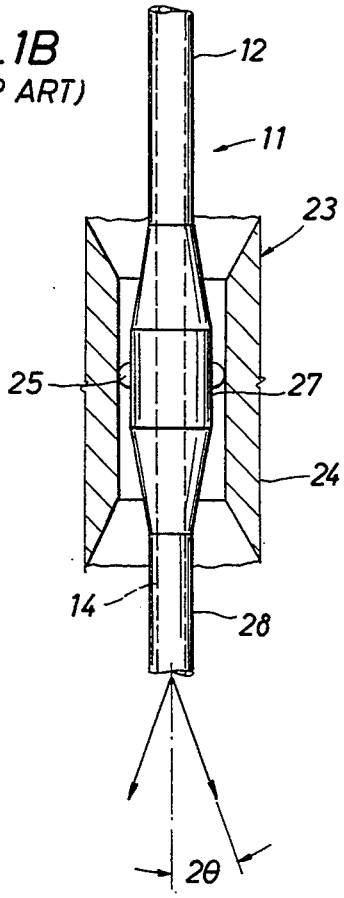
FIG.1B (PRIOR ART)
FIG. 1B is a schematic representation of a "back-to-back" stress joint without the improvement of the present invention.

FIG. 1B schematically illustrates a back-to-back stress joint arrangement 27 in which may be used in combination with the terminal stress joint 20. Combined, the angular rotation at terminal stress joint 20 is reduced by passing tubular element 12 through an intermediate horizontal restraint 23 at which movements orthogonal to the axis of the tubular element are restrained by support structure 24 through sliding support bushings 25. Thus, intermediate horizontal restraint 23 does not resist axial load and provides a pivot point through which angular motion in tubular element 12 is passed, though somewhat reduced, on toward restrained termination 16. Because of this restraining effect, it may be desirable to provide tubular element 12 with a back-to-back stress joint 27, at sliding support bushings 25 and intermediate horizontal restraint 23. At its point in the tubular element, the back-to-back stress joint can accommodate twice the maximum flexure angle as the single stress joint of FIG. 1A, or a maximum flexure of 2Θ.

Combining the stress joint arrangements of FIGS. 1A and 1B, the horizontal deflections in a running span 28 of tubular element 12 are restrained at sliding support bushings 25, but some angular rotation is transmitted therethrough as the support bushings act to pivot the angular rotation from running span 28 with respect to restrained termination 16. Further, restrained termination 16 is fully tensioned as intermediate horizontal restraint 23 is incompetent to transfer any significant axial load from tubular element 12 to support structure 24.

Figure 2:
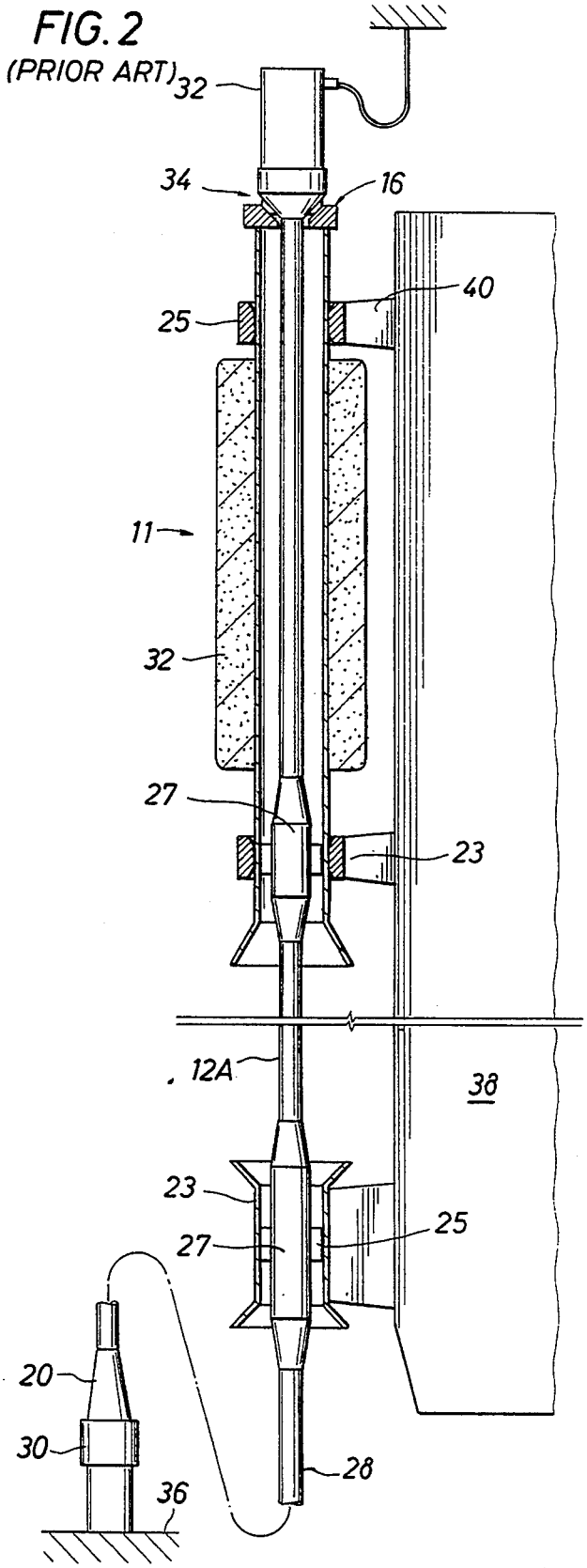
FIG. 2 (PRIOR ART)
FIG. 2 is a side elevation view of a stress joint without the improvement of the present invention.

FIG. 2 illustrates a specific riser application, supported by a guided buoy 32, which again is not provided the benefits of the present invention. This application further increases the angular flexure that a given tubular element can accommodate. In this application, for a large spar structure 38, the tubular element 12 is a riser 12A extending from a wellhead guide 30 at seafloor 36, through a terminal stress joint 20, through two back-to-back stress joints 27, and to restrained termination 16 through restraining fixture 18.

The lowermost back-to-back stress joint 27 is horizontally restrained by a sliding interface at bushings 25 with a first support structure 24. The first support structure is fixedly mounted to the base of spar 38. The second back-to-back stress joint 27 is horizontally restrained at a sliding interface with a second set of bushings 25 by a second support structure 24. The second support structure is vertically supported by guided buoy 32 which is itself horizontally constrained with respect to spar 38 by a sliding connection with upper and lower body guides 40 through bushings 25.

Restrained termination 16 is provided at the upper end of the buoy supported second support structure. Here the restrained termination is provided by a concentric semi-spherical elastomeric bearing assembly 34.

Although the multiple, staged, back-to-back stress joints of FIG. 2 further enhances the angular flexure between the spar and the risers, this remains a fundamental constraint in the design of compliant platforms and even where a design becomes marginally possible, an application may require expensive specialty steels, excessively heavy risers or special fabrication techniques that substantially impact the overall economics of the project.

Figure 3A:
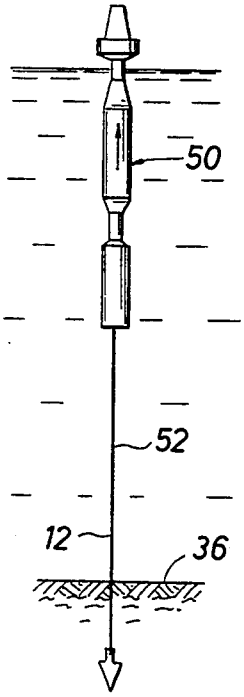
FIG. 3A is a side elevation view of a "long-neck" style spar type compliant structure.
Figure 3B:
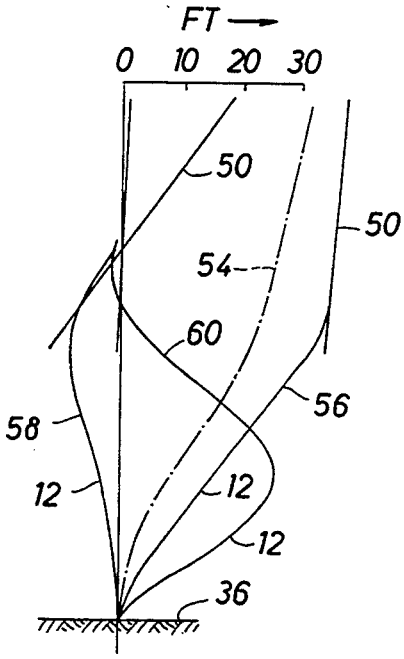
FIG. 3B is a schematic representation of environmentally driven response characteristics for the long-neck style spar of FIG. 3A.
Figure 3C:
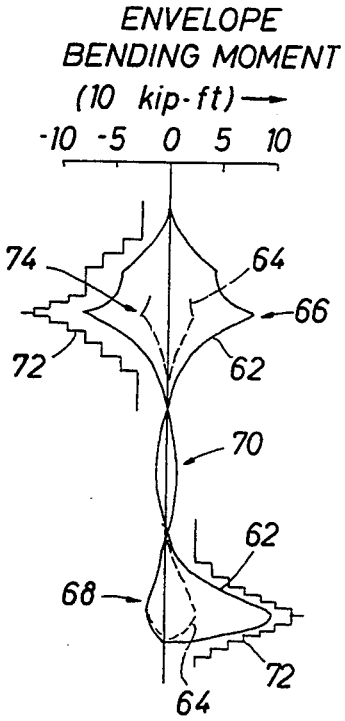
FIG. 3C is a graphical representation of the potential stresses in the riser of the "long-neck" style spar of FIG. 3A.

FIGS. 3A–3C illustrates the critical nature of requirements for angular flexibility. FIG. 3A illustrates a "long-neck" style spar in which a vertically extending hull 50 combines buoyancy over ballast for positive stability and is restrained to seafloor with a net tension in tether 52 for holding position. In this example, the tether is a tubular element 12, perhaps 10 feet in diameter which encircles a bundle of risers. The lower end of tether 52 has been modeled as a pile extending well below the mudline at seafloor 36.

FIG. 3B schematically represents the environmentally driven response characteristics for this style of compliant platform. The horizontal scale has been expanded for the purposes of this figure and have been calculated on the basis of a 900 foot spar deployed in 2000 feet of water. Position 54 represents a static offset driven by steady wind or current. Positions 56, 58 and 60 schematically represent modeshapes for the first, second, and third harmonic frequencies, respectively.

FIG. 3C is aligned with FIGS. 3A and 3B to a common depth scale and plots against depth the maximum bending moment along tether 52 for the extreme design wave at curve 62 and for an annual design wave at curve 64. In this example, a very significant spike 66 in the envelope of bending moment illustrated by curves 62 and 64 is observed in tether 52 at its attachment to hull 50. This spike is primarily as a result of the pitching motion of the spar. Another significant spike, spike 68, is noted at the intersection of the tether and seafloor 36. In this figure, this moment is asymmetrical after including the contribution from drift excursion. A less significant increase is noted at bulge 70 in the middle range of the envelope and results from a bend in the tether in response to bowstring motions (refer back to modeshape 60 in FIG. 3B). Returning to FIG. 3C, pitch tends to produce the critical bending moment for spar type compliant platforms at the tether to hull connection. The maximum bending moment that could be accommodated for a given riser design was calculated and plotted as envelope 72, a critical limitation. The preliminary design studies developing this bending moment envelope relied upon the effects of the extreme draft and mass of the long-neck design, a back-to-back stress joint, and a "concentric wishbone" termination in accordance with U.S. Pat. No. 4,633,801, to maintain the bending stresses within the design limits. Thus, this limitation is seen to substantially drive design for compliant platforms.

Figure 4:
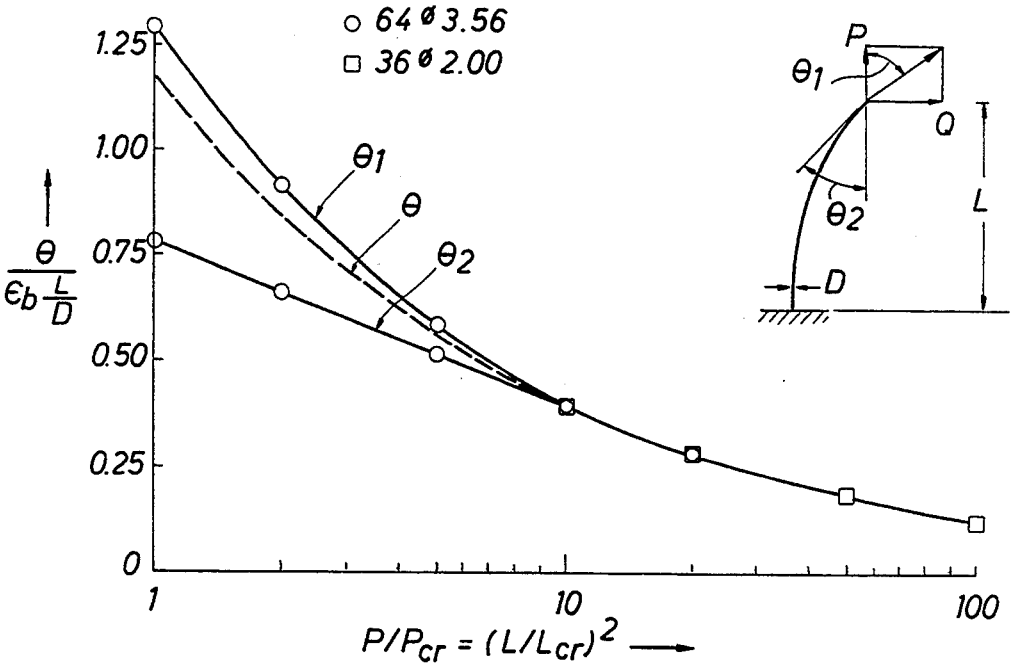
FIG. 4 is a graphical representation correlating bending angle and strain for a rigidly held stress joint.

To gain a more quantitative understanding of the angular flexure allowed in a design, it is useful to analyze the stresses in a tether or riser under tension load P by analogy to a flexible cantilever beam of length L and diameter D as shown in the insert to FIG. 4. The nonlinear P-Δ effect is included. Rotations of the load vector $\Theta_1$ and the free end of the beam $\Theta_2$ are normalized on that of a short cantilever with no tension. If the beam is sufficiently long, and under tension, it would align with the load, like a cable. However, the bending is concentrated near the termination, reducing the angle that can be achieved for a given bending strain $\epsilon_b$. This concentration is apparent in FIG. 3C in how fast the spikes drop off that translates to a "kinkiness" that facilitates failure. For example, the gentling of this concentration in bending moment at the tether-hull connection is apparent where a back-to-back stress joint is employed at point 74 in this graph.

Although the beam is in tension, it turns out that a useful normalizing parameter for this "kinkiness" effect is the critical buckling load in compression $P_{cr}$, given the length (or conversely, the critical buckling length, $L_{cr}$ given the load). In this manner, the limiting strain in the riser top is reduced to a function of the top angle and the top tension with sufficient accuracy for preliminary sizing and for some design evaluation purposes. The validity of this normalizing factor has been confirmed with runs analyzing two different riser tube sizes through a general purpose finite difference beam-column program with the results graphed in FIG. 4.

Surprisingly, at the limit, the maximum angle that can be accommodated at a given bending strain is independent of diameter and length, but depends on the axial stress (or strain, $\epsilon_a$). A single stress joint having a constant diameter which is unaided by a tapered stress joint would have an allowable angle which con be modeled by the following relation:

$$\theta_o = .66\,\epsilon_b/\sqrt{\epsilon_a}$$

Recall that the maximum angle that can be accommodated or the available rotation $\Theta$ for a restrained termination 16 (see FIG. 1A) is essentially doubled if the tubular element 12 in a stress joint in which tubular element 12 is passed through lateral support structure 24 in a non-axially supporting, freely rotatable manner for an available rotation of $2\Theta$ for tubular goods of uniform cross section. However, this performance can be substantially improved by taking into account the effects of axial loading discussed above. Such an improvement is the subject of the present invention.

The present invention is an improved stress joint in which the lateral support is replaced with a connection that provides significant axial support to the tubular element. FIG. 5 illustrates one embodiment of an improved stress joint 10 in accordance with the present invention. Here the axial load in running span 28 is substantially reduced in intermediate tension relief connection 100 which nevertheless passes significant angular rotation to a tension reduced backspan 102. This provides substantially improved allowable rotation between running span 28 and restrained termination 16.

Returning to the premises of the mathematical modeling, a freely rotating back-to-back stress joint which passes angular rotation, but no axial load to a backspan of the tubular element would establish a backspan that does not suffer from the same "kinkiness" as a stress joint which is under tension. The tension relieved backspan has a rotational stiffness of 3EI/L, and provides an additional rotation of:

$$\Theta_1 = 0.66\,\epsilon_b\,L/D$$

The total available rotation then becomes the sum of $\Theta_0$ and $\Theta_1$. Calculations based on this model, with an untensioned backspan, demonstrate an improvement of 2 to 6 times the total allowable rotation accommodated by a combined stress joint of FIG. 1. This then equates to a 4 to 12 fold improvement over that for a restrained termination as illustrated in FIG. 1A alone (but with constant diameter tubular elements) modeled for riser or tether applications. The advantage is greatest for cases with high axial stress. Total angular rotations of up to 21 degrees were demonstrated as possible for riser applications without compromising the continuous hard-piped pressure integrity. This greatly extends the range of compliant platform designs that can be considered for use with production risers from conventional tubular elements and topside wellheads. Similarly, this expands the range of hull forms appropriate for economical restrain in a combination riser and tether system.

Of course, the foregoing modeling is based on simplifications that, although appropriate for feasibility and preliminary design studies, may not prove quantitatively definitive. Nevertheless these results are qualitatively significant. More detailed analysis would include, but not be limited to, the benefits of tapered stress joints, the effects of elastomeric supports with non-zero rotational stiffness, and coupled analysis of hull, risers and/or tethers together.

Figure 6:
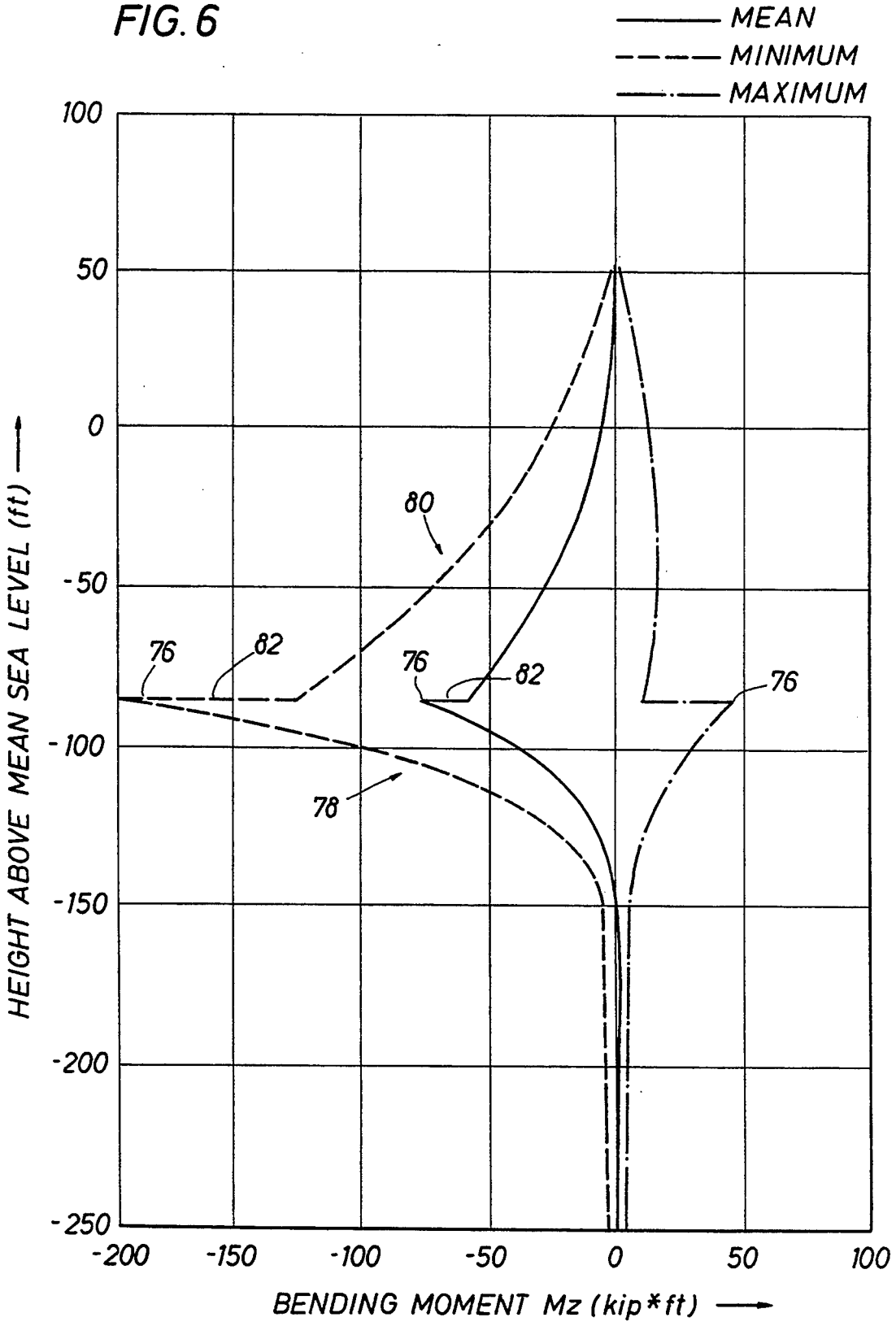
FIG. 6 is a graphical representation of the bending moment calculated with respect to position along the riser in a compliant structure having the benefit of the present invention.

A more detailed analysis of the benefits of the present invention in application to a riser's bending envelope is illustrated in the graph of FIG. 6. This graph plots the calculated bending moment against position along the riser at the riser-hull connection in a compliant structure of the style described with FIGS. 8C and 8D, below.

Returning to FIG. 6, a tension relieving support connected to the keel at the −75 foot level separates the running span therebelow from the backspan thereabove and results in spike 76 in the bending moment noted at that level. Region 78 of the curve for bending moment in the running span immediately below the tension relief support is seen to drop off far more quickly than does the bending moment in backspan region 80, demonstrating the reduced "kinkiness" in the backspan. The abnormality at region 82 represents the inefficiencies of an elastomeric bearing in freely passing angular rotation through the tensioning relieving support.

Returning to FIG. 5, this application of improved support system 10 supports tubular element 12 in the form of the production riser 12A from compliant structure 38 in the form of a large spar structure analogous to that disclosed in FIG. 2.

Support structure 100 includes an operable tensioner which is, in this embodiment, a subsea rocking arm tensioner 100A comprising a rocking arm 108 pivotally mounted to the keel of compliant structure 38 at one end and connected to riser 12A through semispherical elastomeric bearing 110. Rocking arm 108 is supported by strut member 112 by which controlled tension may be applied to riser 12A at the connection with elastomeric bearing 110. Support structure 100 is an intermediate tension relief connection or intermediate tension support by which a significant portion of the load of the riser is transferred to the keel of compliant structure 38. Support structure 100 serves to restrain the riser from lateral deflection (aside from minor components due to the arcing motion of the rocking arm) yet, through elastomeric bearing 110, passes significant angular rotation.

Intermediate tension support 100 separates running span 28 of the riser from backspan 102. In this application, wellhead 118 at the distal end of the backspan is secured with respect to compliant structure 38 through restrained termination 16, here provided by a pivotal link 120. Thus, intermediate tension relief connection 100 supports a significant portion of the load of running span 28 of riser 12A which is connected to a subsea facility such as a foundation, well guides, etc. a substantial distance therebelow in a manner analogous to that illustrated in FIG. 2. Taking this load from the substantial weight of the riser out at the intermediate tension relief connection provides a substantially reduced axial load in backspan 116. As discussed in the foregoing, this provides greater allowable angles at the keel, while the base of wellhead 118 which is held substantially in place through restrained connection 16.

FIGS. 7A–7D, 8A–8D and 9 illustrate a range of some of the many other embodiments and applications for the present invention in the support of risers and tethers in deepwater offshore applications.

Figure 7A:
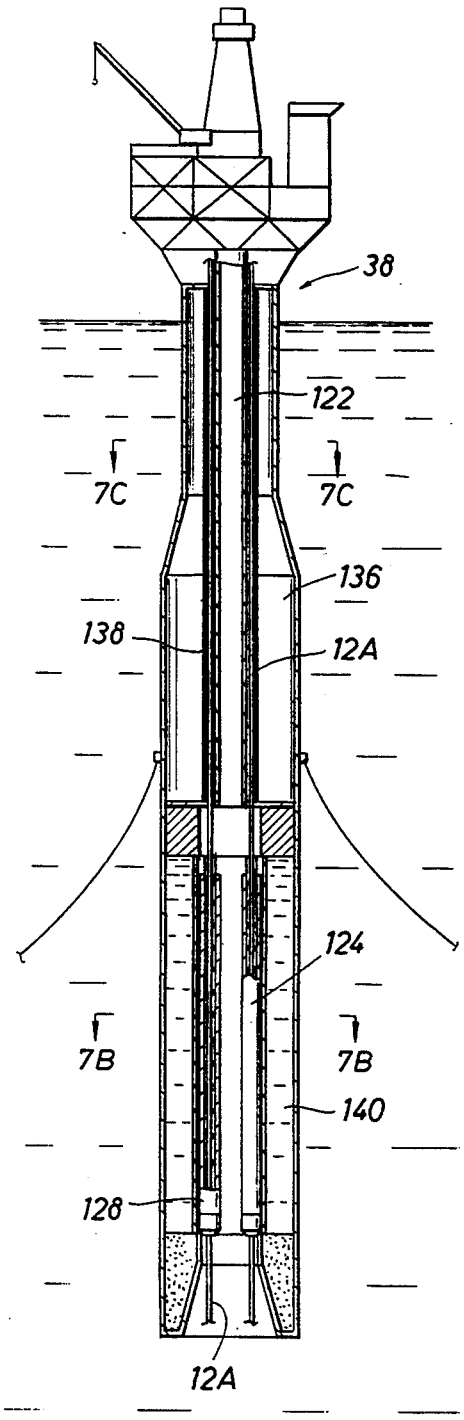
Figure 7D:
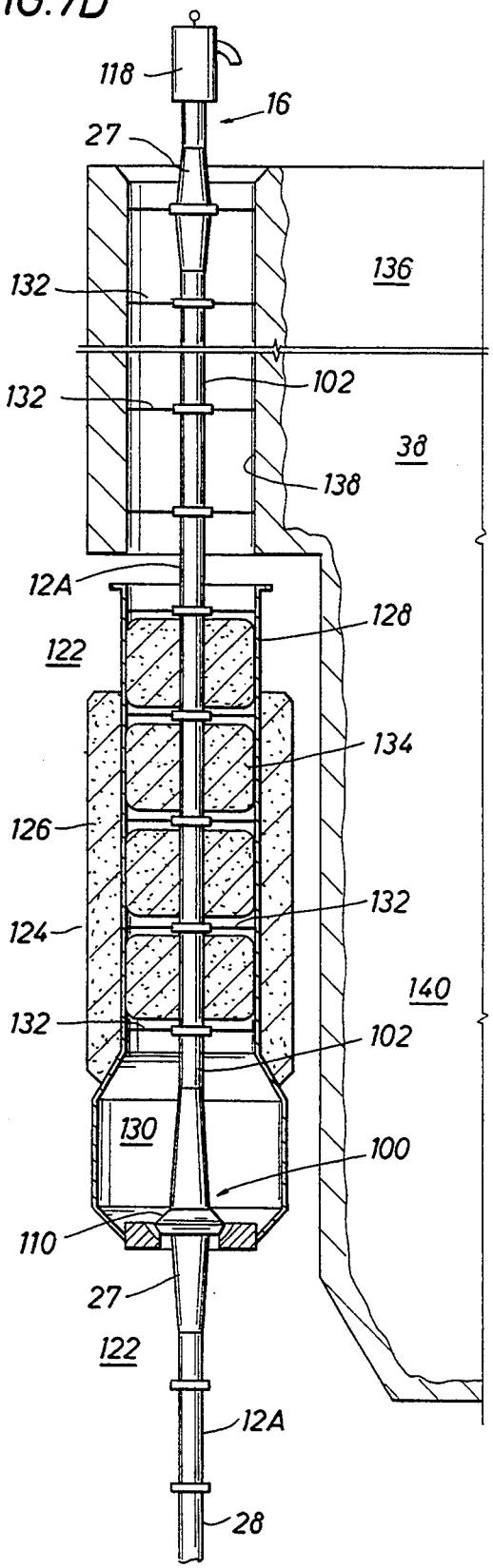

FIGS. 7A–7D illustrates a large spar application similar to similar to that of FIG. 2, but employing improved support system 10 of the present invention. FIG. 7A shows large spar structure 38 which has been cross sectioned to reveal central moon pool 122 around which a plurality of risers 12A are arranged. FIG. 7D illustrates the riser/spar interface in greater detail, enlarging these components and selectively abbreviating the vertical scale on a 10:1 ratio for the convenience of illustration.

Intermediate tension relief connection 100 is provided by guided buoy 124 which is supported by buoyancy module 126 around a cylindrical body guide member 128. This provides a tension relieved backspan 102 which is separated from the full tension running span 28 in riser 12A.

An elastomeric bearing 110 at the base of the body guide member supports riser 12A at back-to-back stress joint 27 and a chamber 130 is provided within body guide member 128 to accommodate rotation passed through the elastomeric bearing. Following chamber 130, a series of centralizers 132 and supplementary buoyancy modules 134 are provided along the backspan of riser 12A within body guide member 128. At this section of the backspan, the riser and its concentric guided buoy 124 runs within moon pool 122 along the ballast section 140 of spar structure 38. See FIG. 7A and the cross section of FIG. 7B.

Returning to FIG. 7D, tension relived backspan 102 extends from body guide member 128 of guided buoy 124 and runs through an individual riser duct 138 which extends through buoyancy tank section 136 of spar structure 38. See also FIGS. 7A and 7D. Returning again to FIG. 7D, additional centralizers 132, potentially of varying degrees of stiffness, are provided within riser duct 138, leading to a wellhead 118 which is substantially rigidly mounted to a deck of spar structure 38. Restrained connection 16 may also be provided with a back-to-back stress joint 27, as illustrated.

Figure 8A:
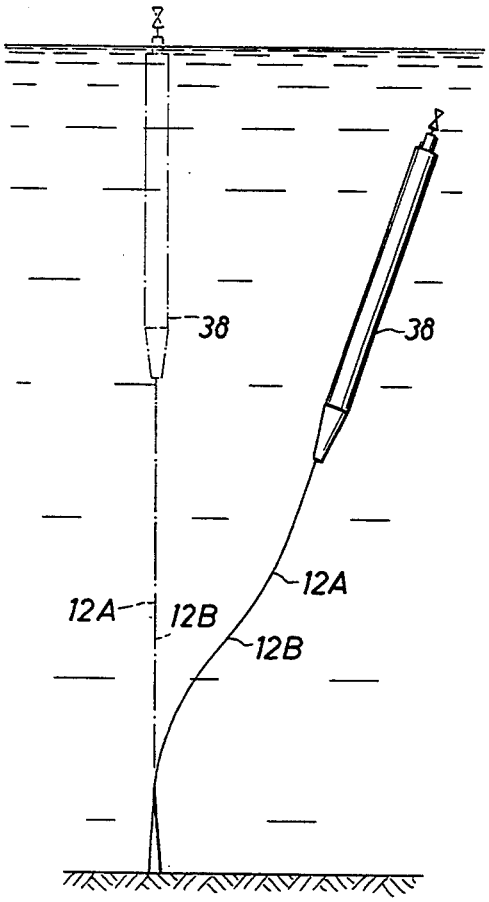
FIGS. 8A–8D illustrate a range of other compliant structures aided by a backspan stress joint in accordance with the present invention.

FIG. 8A is a very small spar design in contrast to that of FIGS. 7A–7D. This is a "tulip" style spar design and features a single riser 12A which also serves as a tether 12B. The range of motion that must be accommodated by the riser 12A to spar 38 connection for this design is a particular challenge and illustrates the additional design flexibility facilitated by the application of the present invention.

Figure 8B:
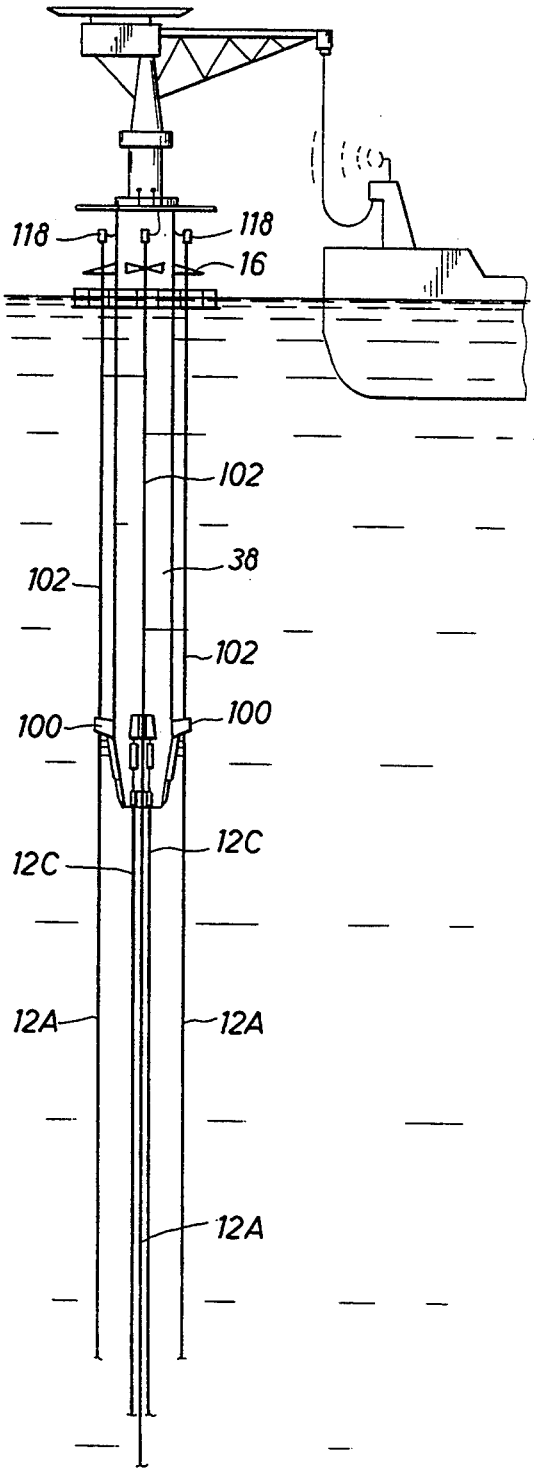

FIG. 8B is a larger spar 38, here for an offloading facility which employs an external ring of risers 12A, with an external intermediate tension relief connection 100 at the base of the spar and a tension relieved backspan 102 leading fixed wellheads 118 in restrained termination 16. A plurality of separate tethers 12C are arranged concentrically within the ring of risers 12A.

Figure 8C:
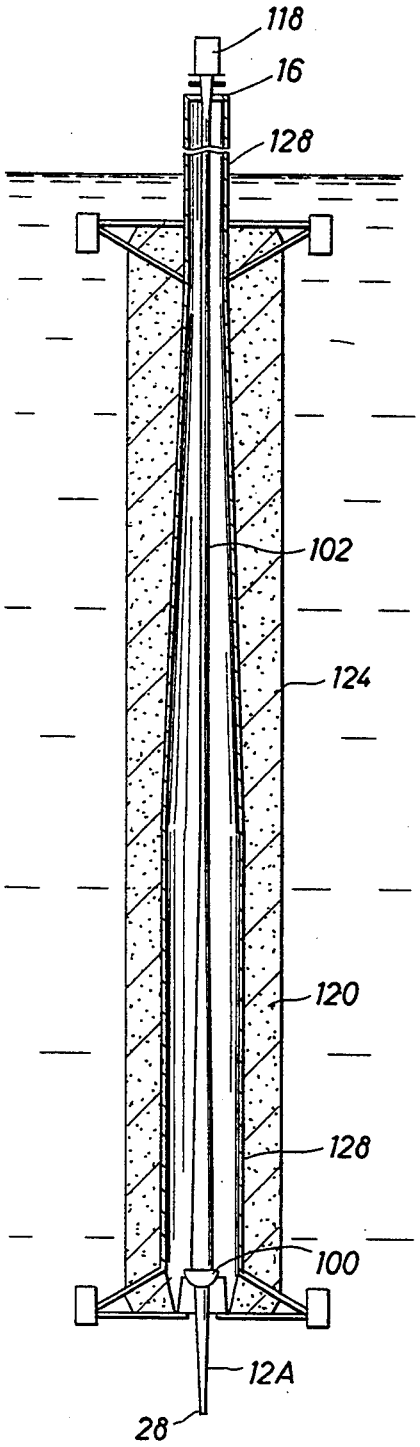
Figure 8D:
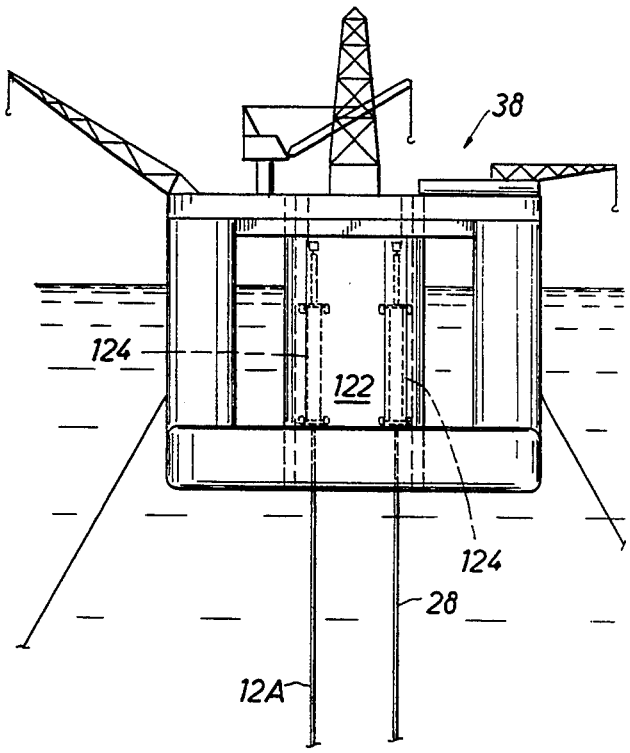

FIGS. 8C–8D illustrate another application of the present invention through a plurality of guided buoys 124, here supporting risers 12A within a moon pool 122 of a semisubmersible production storage and offloading facility 38. Tension in running span 28 of risers 12A is relieved in intermediate tension relieving connection 100 at the base of body guide member 128 which is surrounded by buoyancy module 120 to form a tension relieved backspan 102 leading to wellhead 118 which is fixedly secured to the top of body guide member 128 in restrained connection 16.

Figure 9:
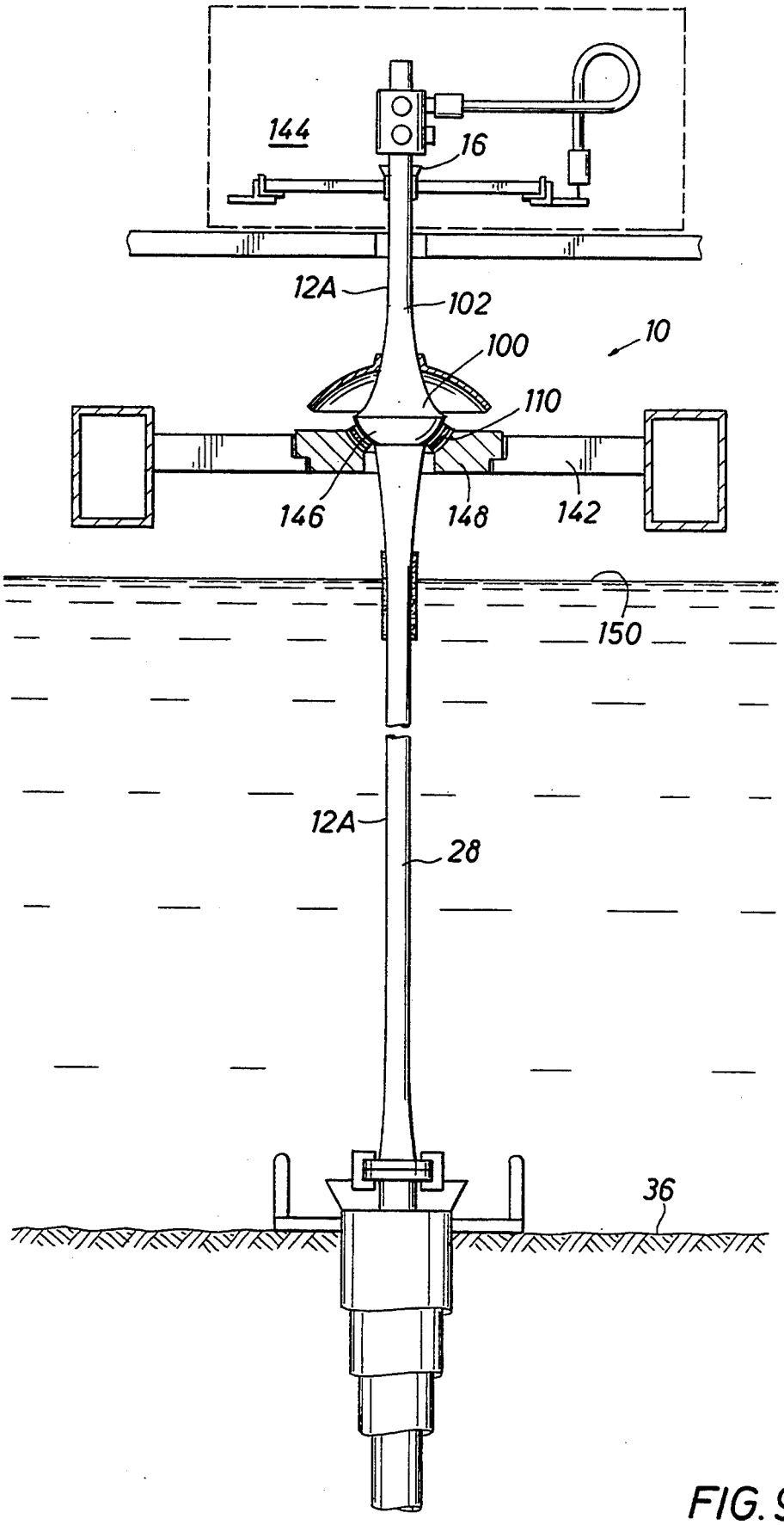
FIG. 9 is a riser supported by a compliant tower in which the riser is secured through a backspan stress joint an application of the present invention.

FIG. 9 schematically illustrates an improved support system 10 for use within a plurality of decks provided on a compliant structure. Thus, tension in running span 28 is relieved at intermediate tension relief connection 100 and passed to first deck 142 and tension relieved backspan 102 extends to a wellbay 144 at which the top of riser 12A is secured at restrained termination 16 immediately below wellhead 118. Connection 100 deploys a semispherical bulb 146 in conjunction with elastomeric bearing 110 which is supported by deck 142 through a plurality of plates 148 which encircle riser 12A as it passes through the support deck. In this illustration, support deck 142 is above ocean surface 150, but this support could, in the alternative, be subsurface. This embodiment might be employed in a range of compliant structures, including multi-deck tension leg platforms and compliant towers.

Another set of alternatives for deploying the present invention to a subsea structure at the lower riser termination, adjacent the wellguide. Recall that in FIG. 3C there is another spike in the bending moment, this one at the ocean floor. The present invention may thus also be deployed to transfer a net tension load to a foundation member by connecting the intermediate tension support to such foundation member. This would enable a restrained connection such as the ultimate connection of a tether or tendon to a foundation or subsea facility or restrained at the passage into the seafloor.

A number of variations have been disclosed for the improved support system or backspan stress joint of the present invention. However, other modifications, changes and substitutions are intended in the foregoing disclosure. Further, in some instances, some features of the present invention will be employed without a corresponding use of other features described in these preferred embodiments. Accordingly, it is appropriate that the appended claims be construed broadly and in a manner consistent with the spirit and scope of the invention herein.

What is claimed is:

1. An improved support system for providing flexibility to a restrained termination of a highly pressurized, highly tensioned tubular element in an offshore application extending from a subsea facility to a compliant structure, comprising:

an elongated running span in the tubular element;

an intermediate tension relief connection operably connecting the tubular element to a support structure to transfer a significant portion of the tension carried by the tubular element in a manner that passes angular rotation of the tubular element; and a backspan in the tubular element having reduced tension and separated from the running span of the tubular element by the intermediate tension relief connection.

2. An improved support system in accordance with claim 1 wherein the backspan is structurally continuous with the running span of the tubular element, though separated by the intermediate tension relief connection.

3. An improved support system in accordance with claim 2 wherein the running span of the tubular element extends vertically and the intermediate tension relief connection restrains the lateral deflection of the tubular element.

4. An improved support system in accordance with claim 3 further comprising:

a flexible stress joint in the tubular element at the restrained termination thereof, the flexible stress joint being spaced from the running span by the backspan in the tubular element.

5. An improved support system in accordance with claim 4 wherein the tubular element is a riser and the support structure is operably connected to the compliant structure, further comprising a wellhead connected to the restrained termination.

6. An improved support system in accordance with claim 5 wherein the tubular element also serves as a tendon and the support structure is a subsea facility.

7. An improved support system in accordance with claim 4 wherein the tubular element is a tendon and the support structure is a subsea facility.

8. An improved riser support system for supporting a riser from an offshore compliant structure, comprising:

a running span in the riser;

a riser support stress joint in the riser connected to the running span;

an intermediate tension support operably connected to the riser support stress joint to accept a significant portion of the riser load;

a backspan stress joint in the riser connected to the riser support stress joint;

a riser backspan in the riser connected to the backspan riser stress joint; and a wellhead connected to the riser backspan at the distal end.

9. An improved riser support system for supporting a riser from a support structure associated with an offshore compliant structure, the riser support system comprising:

an elongated riser span presented in the riser;

an intermediate tension support operably connecting the riser to the support structure which accepts a significant portion of the riser load and passes a significant angular rotation of the riser;

a riser support stress joint presented in the riser immediately below the riser to intermediate tension support connection for providing angular flexibility between the riser span and the intermediate tension support;

a reduced axial load riser backspan presented in the riser above the intermediate tension support;

a backspan stress joint presented in the riser immediately above the riser to intermediate tension support connection for providing angular flexibility between the riser backspan and the intermediate tension support; and a wellhead connected to the riser at the distal end of the riser backspan.

10. A riser support system in accordance with claim 9 wherein the intermediate tension support further comprises a concentric semi-spherical elastomeric bearing between the riser and the support structure.

11. A riser support system in accordance with claim 10 wherein the support structure is a buoyant member which forms the compliant structure.

12. A riser support system in accordance with claim 11 wherein the buoyant member is a buoy which is arranged concentrically about the riser with the elastomeric bearing rigidly secured to the base of the buoy and providing the intermediate tension support for the riser.

13. A riser support system in accordance with claim 11 wherein the support structure is a spar accepting a plurality of tangentially arranged risers, each connected in a respective riser support at the base of the spar through one of a plurality of the elastomeric bearings.

14. A riser support system in accordance with claim 13 further comprising a plurality of riser supports, each connected between the compliant structure and the top of the riser at the end of the backspan and below the wellhead to restrain the wellhead with respect to the compliant structure.

15. A riser support system in accordance with claim 9 further comprising an operable tensioner supported by the compliant structure and connected to the intermediate tension support.

16. A riser support system in accordance with claim 9 wherein the support structure is a primary buoyancy module horizontally restrained with respect to the compliant structure.

17. A riser support system in accordance with claim 9 wherein the support structure further comprises:

a rocker beam extending outwardly from a pivoting connection with the compliant structure, the outboard end of the rocker beam supporting the riser through the semi-spherical elastomeric bearing; and a tensioning controlling strut member pivotally connected between the compliant structure and the rocker beam.

18. A riser support system in accordance with claim 17, further comprising:

a riser support connected between the compliant structure and the top of the riser at the end of the backspan and below the wellhead to restrain the wellhead with respect to the compliant structure.

19. A riser support system in accordance with claim 18 wherein the riser support is a link pivotally connected to both the riser and the compliant structure.

20. A riser support system in accordance with claim 9 wherein the riser support stress joint is a downwardly tapered stress joint.

21. A riser support system in accordance with claim 20 wherein the backspan stress joint is an upwardly tapered stress joint arranged back-to-back with the riser support stress joint and therewith bracketing the connection of the riser to the intermediate tension support.

22. A riser support system in accordance with claim 21 wherein the intermediate tension support allows free angular rotation of the riser.

23. A riser support system in accordance with claim 22 wherein the riser is fixedly secured at the wellhead to the top of a buoyancy module.

24. A riser support system in accordance with claim 23 wherein the intermediate tension support provides a direct, elastic resisting moment to angular rotation of the riser.

25. A method for increasing riser flexibility at a riser termination for an offshore riser connecting subsea facilities to a compliant structure, the method comprising:

relieving the axial load in the riser at an intermediate riser support;

passing angular rotation of the riser through the intermediate riser support to a backspan of the riser having a reduced axial load;

terminating the riser in a restraining fixture at the distal end of the backspan, spaced apart thereby from the intermediate riser support.

26. A method for increasing riser flexibility at a riser termination in accordance with claim 25 further comprising:

relieving stress in the riser with a riser support stress joint which tapers in an increasing diameter from the end of the riser having maximum load to the intermediate riser support;

relieving stress in the riser with a backspan stress joint arranged back-to-back with the riser support stress joint and tapering in a decreasing diameter from the intermediate riser support toward the riser termination; and relieving stress in the riser at the restraining fixture with a terminal stress joint.

27. A method for increasing riser flexibility at a riser termination in accordance with claim 26 wherein the steps of relieving the axial load and passing angular rotation of the riser through the intermediate riser support is accomplished by operably connecting the riser to a support structure through a concentric semi-spherical elastomeric bearing.

28. A method for increasing riser flexibility at a riser termination in accordance with claim 27 wherein a surface wellhead is provided at the riser termination and relieving the axial load of the riser at the intermediate riser support comprises connecting the intermediate riser support to the compliant structure.

29. A method for increasing riser flexibility at a riser termination in accordance with claim 26 wherein a wellhead is provided at the riser termination and relieving the axial load and passing angular rotation of the riser through the intermediate riser support is accomplished by connecting the intermediate riser support to a buoyant member and horizontally restraining the buoyant member with respect to a compliant structure.

30. A method for increasing riser flexibility at a riser termination in accordance with claim 25 wherein the riser termination is to a subsea structure adjacent the ocean floor and wherein relieving the axial load of the riser at the intermediate riser support comprises connecting the intermediate riser support to the subsea structure.

31. A method for increasing flexibility at a termination of a highly tensioned, pressurized tubular element deployed in a deepwater, offshore application to connect a subsea facility to a compliant structure, the method comprising:

relieving the axial load in the tubular element at an intermediate support;

passing angular rotation of the tubular element through the intermediate support to a backspan of the tubular element having a reduced axial load;

terminating the tubular element in a restraining fixture at the distal end of the backspan, spaced apart thereby from the intermediate support.

* * * * *